US010334913B2

(12) United States Patent
Nettles

(10) Patent No.: US 10,334,913 B2
(45) Date of Patent: Jul. 2, 2019

(54) ADJUSTABLE ZIPPER PULL ASSEMBLY

(71) Applicant: Kimberly Nettles, Detroit, MI (US)

(72) Inventor: Kimberly Nettles, Detroit, MI (US)

( * ) Notice: Subject to any disclaimer, the term of this patent is extended or adjusted under 35 U.S.C. 154(b) by 120 days.

(21) Appl. No.: 15/170,042

(22) Filed: Jun. 1, 2016

(65) Prior Publication Data

US 2017/0347757 A1 Dec. 7, 2017

(51) Int. Cl.
*A44B 19/26* (2006.01)

(52) U.S. Cl.
CPC ..... *A44B 19/262* (2013.01)

(58) Field of Classification Search
CPC .... A44B 19/262; Y10T 24/3913; G09F 3/037
See application file for complete search history.

(56) References Cited

U.S. PATENT DOCUMENTS 2,440,012 A * 4/1948 Haver ..... G09F 3/0352 24/116 A
3,290,080 A * 12/1966 Dawson ..... G09F 3/0352 24/704.2
3,712,655 A * 1/1973 Fuehrer ..... F16B 21/071 24/16 PB
3,780,400 A * 12/1973 Hinsperger ..... A44B 1/185 24/114.7
4,093,288 A * 6/1978 Suzuki ..... F16B 2/08 24/16 PB
4,636,347 A * 1/1987 Kato ..... B29C 45/14549 264/154
4,991,265 A * 2/1991 Campbell ..... B65D 63/1027 24/128
5,222,701 A * 6/1993 Rowland ..... B65H 75/366 248/222.13
6,415,482 B1 7/2002 Pontaoe
6,560,829 B1 5/2003 Chen
6,581,254 B1 6/2003 Tang
7,043,802 B2 5/2006 Moeller et al.
7,117,567 B1 10/2006 Krulik et al.
8,205,306 B2 6/2012 Kovach et al.
9,499,317 B2 * 11/2016 Comaniuk ..... F16L 3/137
2002/0069494 A1 6/2002 McCrum
2002/0179655 A1 12/2002 Finlay
2005/0022347 A1 2/2005 Yang
2009/0144944 A1 * 6/2009 Chen ..... B65D 33/1616 24/30.5 L
2009/0265899 A1 10/2009 Yang
2009/0276984 A1 11/2009 Rabe
2013/0212841 A1 8/2013 Castaline et al.

* cited by examiner

*Primary Examiner* — Robert Sandy
*Assistant Examiner* — Rowland Do
(74) *Attorney, Agent, or Firm* — Wayne State Law School Patent Clinic

(57) ABSTRACT

The adjustable zipper pull assembly includes a cord having a plurality of protrusions extending from the cord. A slidable member is disposed on the cord and is slidable relative to the cord. The slidable member includes a first aperture that receives a first region of the cord, and a second aperture that receives a second region of the cord such that the cord defines a closed loop. The slidable member and the protrusions are flexible relative to one another in order to enable the slidable member to slide over the protrusions while sliding relative to the cord, which adjusts a size of the closed loop about a top portion of a zipper slider. The adjustable zipper slider assembly may be used to avoid replacing a damaged zipper slider.

12 Claims, 4 Drawing Sheets

ADJUSTABLE ZIPPER PULL ASSEMBLY

FIELD OF THE INVENTION

The present invention relates to an assembly that replaces a broken zipper pull mechanism, and in particular, a zipper pull assembly that eliminates the need for replacing the entire zipper.

BACKGROUND OF THE INVENTION

Zipper pulls due to their small size and the way they are used, as well as the constant tugging and pulling with every use, are prone to breakage. Users can be neglectful and careless when using them, which can also lead to breakage. A broken zipper pull can negatively affect the usefulness of an object such as a backpack, jacket closure or pant zipper and make them difficult to use or render them unusable for their desired purpose. Breakage of the zipper pull in many instances leads to the entire zipper structure being replaced when only the zipper pull is broken. It is wasteful, expensive and timely to dispose of the undamaged tape teeth, box and pin components of the zipper. Due to the inconvenience of replacing an entire zipper, i.e., pulling out the sewing machine or paying a tailor to replace it, many people opt to purchase an entirely new item. However, it would be much more cost and time efficient to simply replace the zipper pull assembly.

There have been attempts to create a solution for broken zipper pulls, but these attempts have fallen short and have not addressed the needs of users. They do not stay attached during use and are unable to attach to a variety of different sizes and shapes of zippers.

SUMMARY OF THE INVENTION

The invention provides for an adjustable zipper pull assembly, which is capable of wrapping around a zipper slider having any size or shape. The adjustable zipper pull assembly is designed to attach to zipper sliders that have broken. Additionally, the adjustable zipper pull assembly may be used with existing zipper sliders, which are difficult for the user to grasp. There is a cord having several individual protrusions, which run the length of the cord. A slidable member is secured on the cord and is slidable relative to the cord. The first aperture of the slidable member is positioned on the first region of the cord. The second region of the cord may be looped around the top portion of the zipper slider and may be received by the second aperture to form the closed loop. The slidable member and protrusions are flexible relative to one another in order to enable the slidable member to slide over the protrusions while sliding relative to the cord. This sliding ability allows the user to adjust the size of the loop so that it fits securely around a top portion of a multitude of zipper sliders.

The adjustable zipper pull assembly may be attached in a variety of ways to the zipper slider. If the zipper slider is intact but there is no zipper pull, the adjustable zipper pull assembly may be looped through the top portion of the zipper slider and adjusted using the slidable member. If however the top portion of the zipper slider is broken, the adjustable zipper pull assembly may be attached to the remaining portion. As shown in FIG. 3, the first region of the cord is positioned in the first aperture of the slidable member. The second region of the cord may be looped around the top portion of the zipper slider and may be received by the second aperture to form the closed loop, as shown in FIGS. 1, 2, 4 and 5.

DETAILED DESCRIPTION

Figure 1:
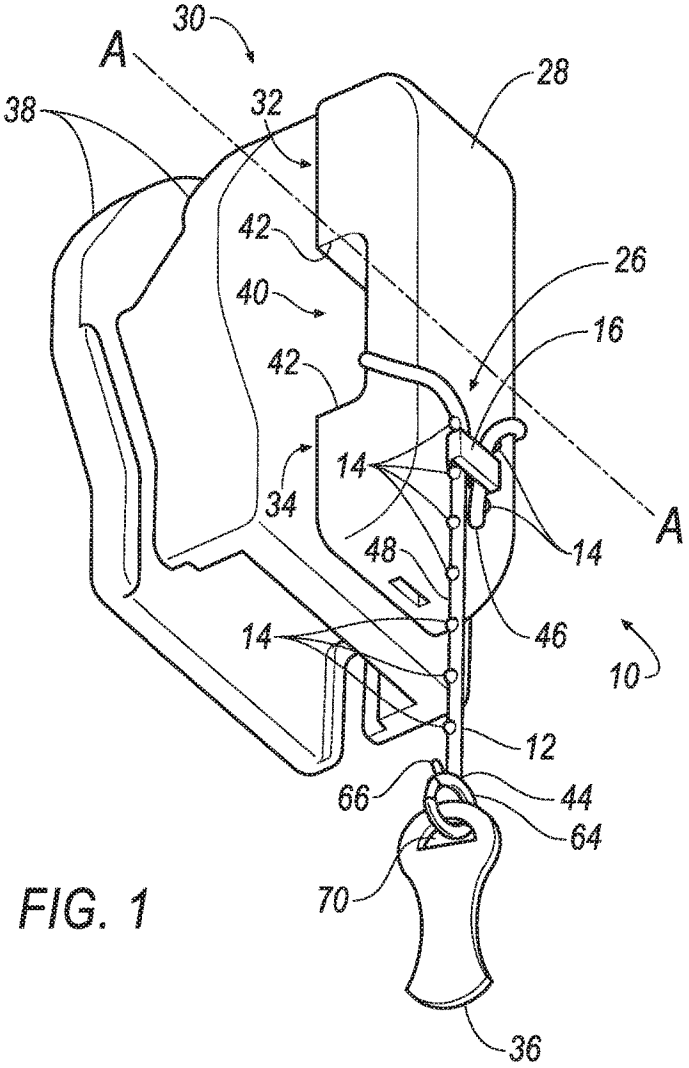
FIG. 1 is a perspective view of a zipper slider and an adjustable zipper pull assembly including a clasp and a zipper pull.

With reference to the Figures, wherein like numerals indicate like parts throughout the several views, FIG. 1 shows an adjustable zipper pull assembly 10. The adjustable zipper pull assembly 10 includes a cord 12 having a plurality of protrusions 14 extending from the cord 12. A slidable member 16 is disposed on the cord 12 and is slidable relative to the cord 12. The slidable member 16 includes a first aperture 18 that receives a first region 20 of the cord, and a second aperture 22 that receives a second region 24 of the cord 12 such that the cord 12 defines a closed loop 26. The slidable member 16 and the protrusions 14 are flexible relative to one another in order to enable the slidable member 16 to slide over the protrusions 14 while sliding relative to the cord 12, which adjusts a size of the closed loop 26 about a top portion 28 of a zipper slider 30.

Figure 2:
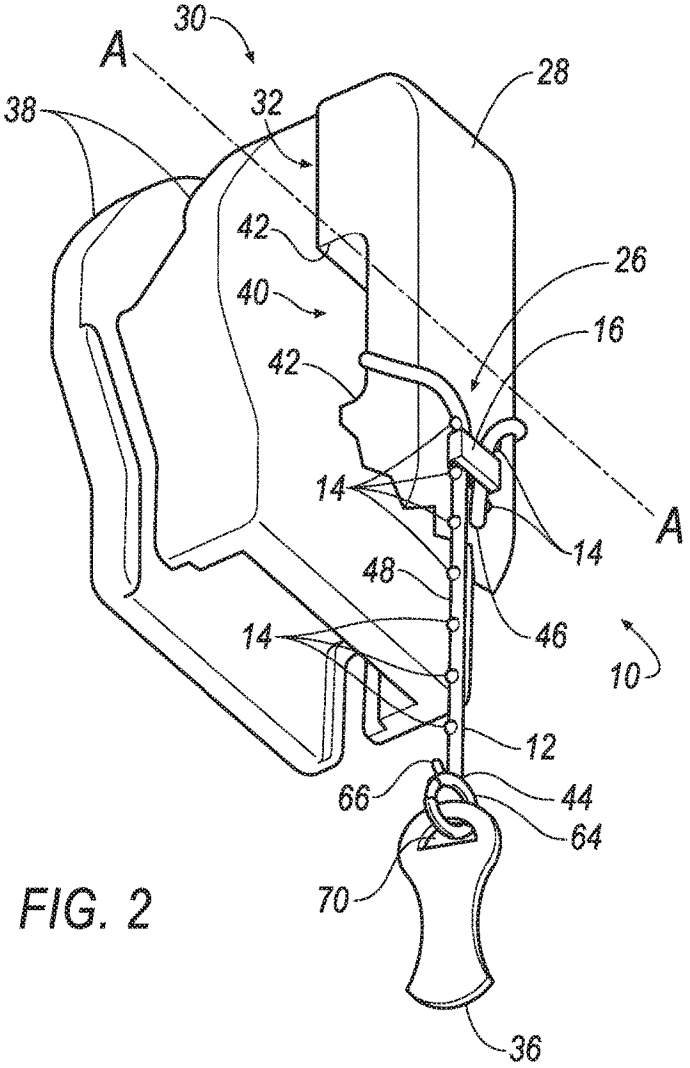
FIG. 2 is a perspective view of FIG. 1 with a damaged zipper slider.
Figure 3:
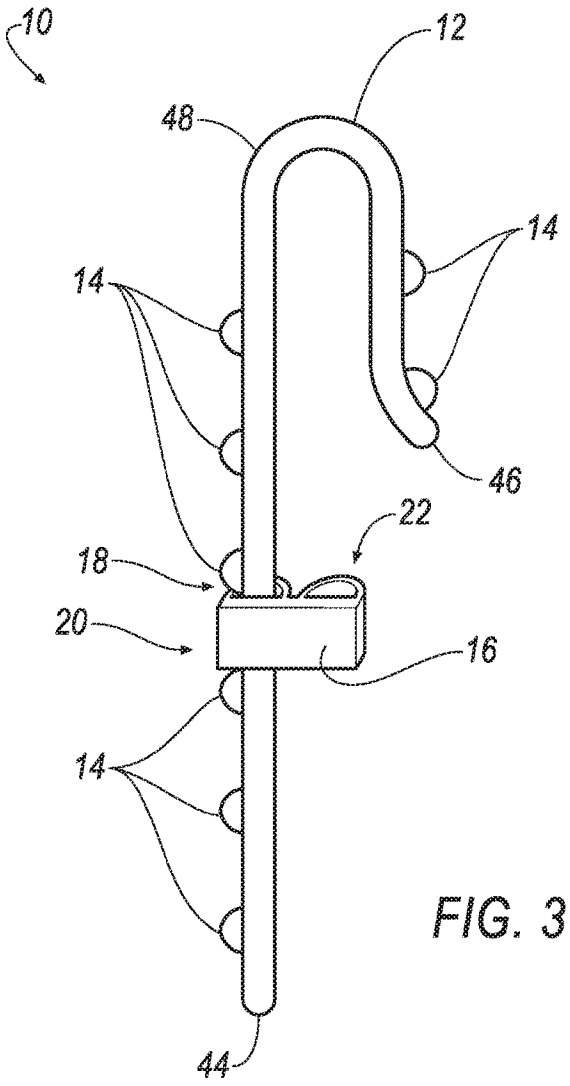
FIG. 3 is a perspective view of a cord, protrusions and a slidable member

As shown in FIG. 1, the top portion 28 of the zipper slider 30 may be attached to the zipper slider 30 at two locations, for example, a first area 32 and a second area 34. The top portion 28 may be damaged and may only be attached to the zipper slider 30 at one location, i.e., the first area 32, as shown in FIG. 2. As shown in FIG. 3, the first aperture 18 of the slidable member 16 is positioned on the first region 20 of the cord 12. The second region 24 of the cord 12 may be looped around the top portion 28 of the zipper slider 30 and may be received by the second aperture 22 to form the closed loop 26, as shown in FIGS. 1, 2, 4 and 5. The size of the closed loop 26, i.e., the cord length between the first region 20 and the second region 24, may be adjusted by sliding the slidable member 16 over the protrusions 14 such that the cord 12 fits tightly around the top portion 28. As set forth below, the adjustable zipper pull assembly 10 may be configured to accept a zipper pull 36. In the situation where the top portion 28 of the zipper slider 30, e.g. a conventional zipper slider, is damaged to the point where the top portion 28 can no longer retain the zipper pull 36, or if the zipper pull 36 itself is damaged, the zipper slider 30 may need to be replaced. Replacing the zipper slider 30 may require replacing the entire zipper assembly, e.g., zipper tape, teeth, retainer box, pins, stop, etc. Attaching the adjustable zipper pull assembly 10 to the top portion 28 may eliminate zipper slider 30 replacement and reduce cost.

With reference to FIG. 1, the zipper slider 30 includes the top portion 28 and a bottom portion 38. The bottom portion 38 may engage with zipper teeth (not shown). As set forth above, the top portion 28 may be fixed to the bottom portion 38 at the first area 32 and the second area 34, as shown in FIG. 1. Alternatively, the top portion 28 may be damaged and may only be fixed to the bottom portion 38 at the first area 32, as shown in FIG. 2. For example, the top portion 28 may be fixed to the bottom portion 38 by welding, ultrasonic welding, fasteners, adhesion, etc. Alternatively, the top portion 28 may be integrally formed with the bottom portion 38, i.e., formed simultaneously as a single continuous unit. For example, the top portion 28 and the bottom portion 38 may be, e.g., die casted, injection molded, etc. The zipper slider 30 be formed of any suitable material, e.g., metal such as stainless steel, aluminum, bronze, etc. Alternatively, the zipper slider 30 may be formed of a plastic, e.g., nylon, polyvinyl chloride (PVC), etc.

The top portion 28 of the zipper slider 30 includes a channel 40 between the first area 32 and the second area 34 where the top portion 28 is not in contact with the bottom portion 38. The channel 40 extends along an axis A transverse to the top portion 28. The channel 40 includes edges 42 that may engage with the cord 12 such that the edges 42 keep the closed loop 26 from becoming separated from the top portion 28, as shown in FIGS. 1-2. Alternatively, the top portion 28 may be damaged such that only one edge 42 remains. In this case, the closed loop 26 of the cord 12 may be secured tight enough to the top portion 28 in order for the adjustable zipper pull assembly 10 to remain engaged with the top portion 28.

As shown in FIGS. 1-5, the cord 12 may include a first end 44 and a second end 46. The first end 44 and/or the second end 46 may be cut to shorten the length of the cord 12. As set forth below, the first end 44 and the second end 46 engage with the slidable member 16 to form the closed loop 26. The cord 12 may be formed of a metallic material, e.g., metal such as steel, aluminum, copper, etc. The cord 12 may include two or more strands of the metallic material in contact with one another. For example, the strands may be bonded, twisted, or braided together to form one cord 12. Alternatively, the cord 12 may be formed of a thermoplastic, e.g., nylon, polypropylene (PP), polyethylene (PE), etc. Alternatively, the cord 12 may be formed of any suitable polymeric material, e.g., thermoplastic elastomer (TPE), etc. The cord 12 may have any suitable cross-sectional shape, e.g., circular (FIGS. 1-5), oval, square, rectangular, etc. The cord 12 may be hollow or solid. In all cases, the material of the cord 12 may be flexible such that the adjustable zipper pull assembly 10 may react to the force of gravity.

With reference to FIGS. 1-5, the protrusions 14 are fixed to the cord 12. The protrusions 14 may be integrally formed with cord 12, i.e., formed simultaneously as a single continuous unit. For example, the protrusion 14 and the cord 12 may be, e.g., die cased, injection molded, etc. Alternatively, the protrusions 14 and the cord 12 can be formed separately from each other and subsequently assembled by, e.g., welding, ultra-sonic welding, adhesion, etc.

Figure 4:
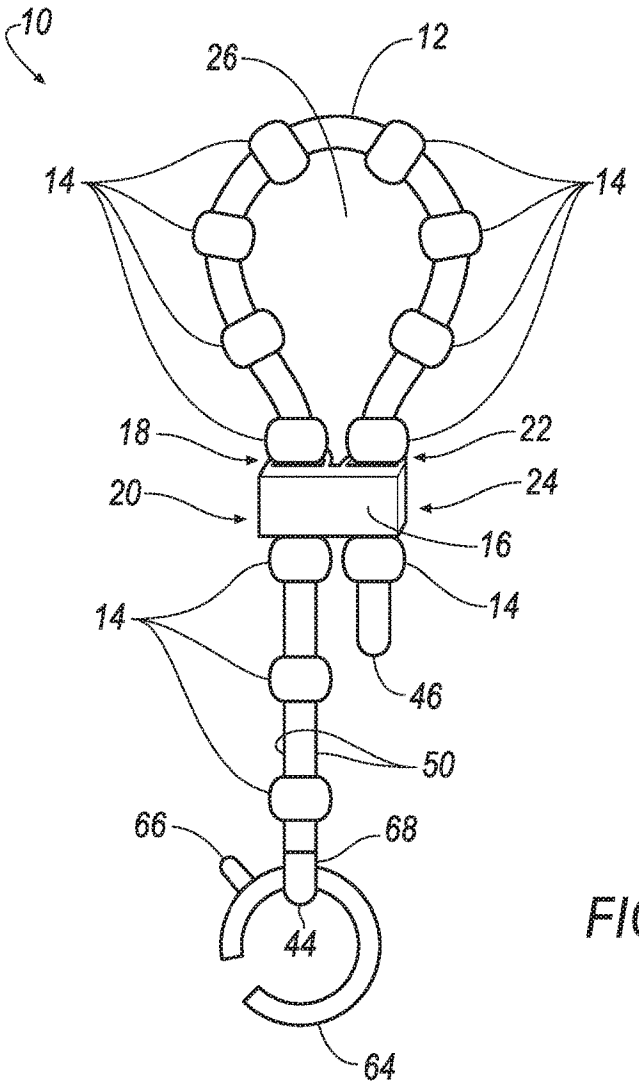
FIG. 4 is a perspective view of the cord, protrusions, slidable member and a clasp with a retractable arm in an open position.

The protrusions 14 may extend along an outer section 48 of the cord 12, as shown in FIGS. 1-3, and 5. Alternatively, the protrusions 14 may extend along a perimeter 50 of the cord 12, as shown in FIG. 4. The protrusions 14 may have any pattern of spacing along the cord 12. For example, the protrusions 14 may be spaced along the entire length of the cord 12, as shown in FIG. 4, or the protrusions 14 may be concentrated in specific areas along the cord 12, as shown in FIGS. 1-3, and 5. The protrusions 14 may be formed of any suitable polymeric material with resilient properties, e.g., thermoplastic elastomer (TPE), rubber, etc. Alternatively, the protrusions 14 may be formed of any rigid metallic material, e.g., steel, aluminum, etc. Alternatively, the protrusions 14 may be formed of any rigid plastic, e.g., acrylonitrile butadiene styrene (ABS), polyvinyl chloride (PVC), etc.

With reference to the Figures and as set forth above, the slidable member 16 includes the first aperture 18 and the second aperture 22. The first aperture 18 or the second aperture 22 may receive the first end 44 of the cord 12, or the second end 46 of the cord 12. Alternatively, the first aperture 18 or the second aperture 22 may receive the first end 44, wherein the first end 44 may traverse the slidable member 16 and may be received by the second aperture 22 or the first aperture 18, respectively. When the slidable member 16 is disposed on the cord 12, i.e., when the first aperture 18 receives the first region 20 of cord 12 and the second aperture 22 receives a second region 24 of the cord 12, the cord 12 defines the closed loop 26. As the slidable member 16 slides over the protrusions 14 (described below), the size of the closed loop 26 is adjusted, i.e., made smaller or larger.

As set forth above, one of the slidable member 16 and the protrusions 14 are flexible relative to one another, which allows the slidable member 16 to slide over the protrusions 14. The slidable member 16 may be formed of any suitable polymeric material with resilient properties, e.g., thermoplastic elastomer (TPE), rubber, etc. Alternatively, the slidable member 16 may be formed of any rigid metallic material, e.g., steel, aluminum, etc. Alternatively, the slidable member 16 may be formed of any rigid plastic, e.g., acrylonitrile butadiene styrene (ABS), polyvinyl chloride (PVC), etc. In one embodiment, the protrusions 14 are made of a material that is more flexible than the slidable member 16, such that the protrusions 14 deflect inward toward the cord 12 as the slidable member 16 slides over the protrusion 14. In another embodiment, the slidable member 16 is made of a material that is more flexible than the protrusions 14 such that the slidable member 16 deflects outward due to pressure from the protrusions 14 as the slidable member 16 slides over the protrusion 14.

Figure 5:
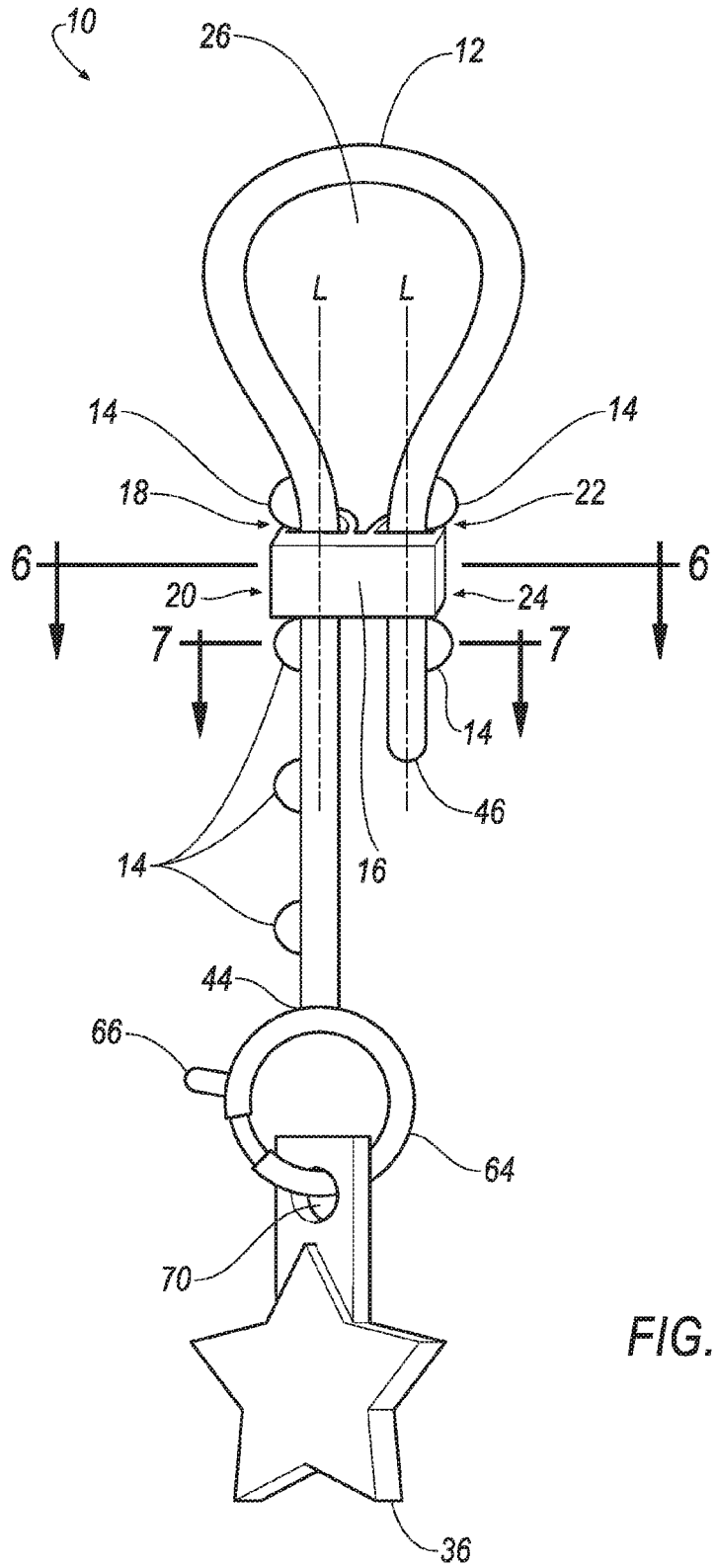
FIG. 5 is a perspective view of the cord, protrusions, slidable member, a zipper pull, and the clasp with the retractable arm in a closed position
Figure 6:
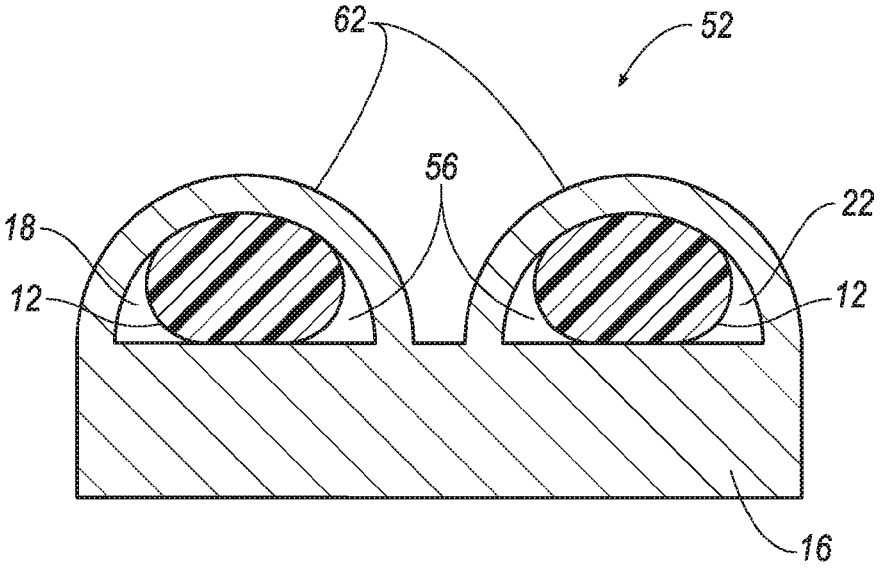
FIG. 6 is a cross-sectional view taken along line 6 of FIG. 5.
Figure 7:
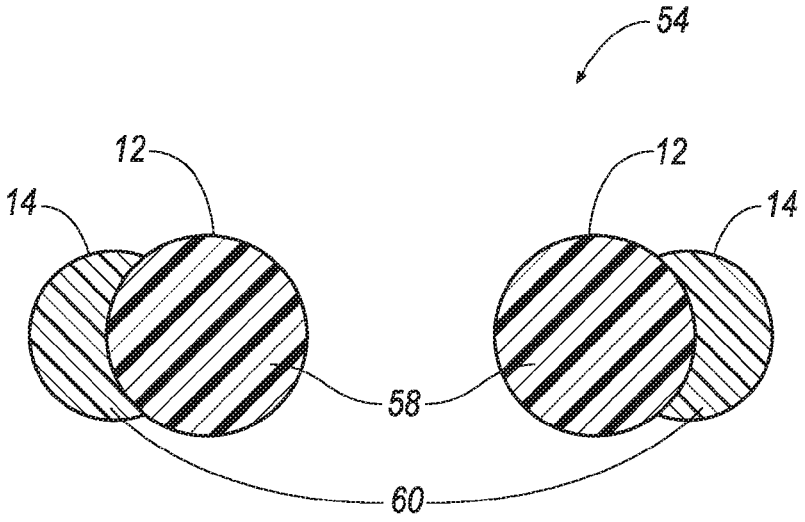
FIG. 7 is a cross-sectional view taken along line 7 of FIG. 5.

With reference to FIG. 5, a first cross-section 52 of the slidable member 16 perpendicular to a longitudinal axis L is shown in FIG. 6, and a second cross-section 54 of the cord 12 and protrusion 14 perpendicular to the longitudinal axis L is shown in FIG. 7. The first cross-section 52 defines an aperture area 56, as shown in FIG. 6. The second cross-section 54 defines a cord area 58 and a protrusion area 60, as shown in FIG. 7. For the case where the protrusions 14 are flexible relative to the slidable member 16, the aperture area 56 may be less than an effective summation area formed by the cord area 58 plus the protrusion area 60.

As shown in FIG. 6, the first aperture 18 and second aperture 22 cross-sectional shape may be semi-circular. Alternatively, the first aperture 18 and the second aperture 22 may have any suitable cross-sectional shape, e.g., square, rectangle, circular, etc. The first aperture 18 and the second aperture 22 may form closed aperture arcs 62, as shown in FIG. 6. Alternatively, the first aperture 18 and the second aperture 22 may have an open segment (not shown).

As shown in FIGS. 1-5, the slidable member 16 may be in a locked position when the slidable member 16 is between two adjacent protrusions 14. The protrusions 14 may restrict the slidable member 16 from sliding when the slidable member 16 is in the locked position. The slidable member 16 may be in an unlocked position (not shown) when the slidable member 16 is sliding over the protrusions 14. The unlocked position of the slidable member 16 occurs, for example, when the closed loop 26 is being adjusted.

As shown in FIGS. 1, 2, 4 and 5, the adjustable zipper assembly 10 may include a clasp 64. The clasp 64 may be fixed to the first end 44 of the cord 12. For example, the clasp 64 may be fixed to the first end 44 of the cord 12 by welding, ultra-sonic welding, adhesive, etc., as shown in FIGS. 1, 2 and 5. Alternatively, the first end 44 of the cord 12 may terminate in a small closed loop 68, as shown in FIG. 4, and the clasp 64 may be fixed to the first end 44, i.e., the clasp 64 is fed through the small closed loop 68 formed at the first end 44. The clasp 64 is configured to encircle and lock about the zipper pull 36, as shown in FIGS. 1, 2 and 5. For example, the clasp 64 may include a retractable arm 66 that moves from an open position to receive the zipper pull 36, as shown in FIG. 4, to a closed position, as shown in FIGS. 1, 2 and 5. Locking of the clasp 64 may be achieved by a spring (not shown) attached to the retractable arm 66 that forces the retractable arm 66 to the closed position when the retractable arm 66 is released. Alternatively, the clasp 64 may be of any suitable type, e.g., lobster clasp, U-clasp, etc.

The clasp 64 may be formed of any suitable material, e.g., metal such as steel, aluminum, etc. Alternatively, the clasp 64 may be formed of an engineered plastic, e.g., acrylonitrile butadiene styrene (ABS), polyvinyl chloride (PVC), sheet molding compound (SMC) composites, etc.

As shown in FIGS. 1, 2 and 5 and as set forth above, the adjustable zipper assembly 10 may include the zipper pull 36. The zipper pull 36 may include an opening 70 that allows the zipper pull 36 to be securely fastened to the clasp 64. The zipper pull 36 may have any suitable shape, e.g., a conventional shape (FIGS. 1-2), a decorative shape (FIG. 5), etc. The zipper pull 36 may be formed of any suitable material.

The disclosure has been described in an illustrative manner, and it is to be understood that the terminology, which has been used is intended to be in the nature of words of description rather than of limitation. Many modifications and variations of the present disclosure are possible in light of the above teachings, and the disclosure may be practiced otherwise than as specifically described.

What is claimed is:

1. An adjustable zipper pull assembly comprising:

a cord;

a plurality of protrusions extending from the cord; and a slidable member disposed on the cord and slidable relative to the cord, the slidable member having a first aperture that receives a first region of the cord, and a second aperture that receives a second region of the cord such that the cord defines a closed loop;

wherein at least one of the slidable member and the protrusions are flexible such that one of the slidable member and the protrusions deflects relative to the other of the slidable member and the protrusions to enable the slidable member to slide over the protrusions while sliding relative to the cord and adjusting a size of the loop about a top portion of a zipper slider.

2. The adjustable zipper pull assembly as set forth in claim 1, further comprising a clasp fixed to the cord, the clasp configured to encircle and lock about a zipper pull.

3. The adjustable zipper pull assembly as set forth in claim 1, wherein the protrusions are formed of a resilient material.

4. The adjustable zipper pull assembly as set forth in claim 1, wherein the protrusions are formed of a metallic material.

5. The adjustable zipper pull assembly as set forth in claim 1, wherein the protrusions are formed of a rigid plastic material.

6. The adjustable zipper pull assembly as set forth in claim 1, wherein the protrusions extend in equidistant increments along an outer section of the cord.

7. The adjustable zipper pull assembly as set forth in claim 1, wherein the protrusions extend along a perimeter of the cord.

8. The adjustable zipper pull assembly as set forth in claim 1, wherein at least one of the first and second apertures extends along a longitudinal axis, the at least one of the first and second apertures having a cross-section perpendicular to the longitudinal axis defining an aperture area, and wherein the cord extends along a cord axis, with the cord having a cord cross-section perpendicular to the cord axis and through one of the protrusions that is not received in the at least one of the first and second apertures, and with the cord cross-section defining a cord area and a protrusion area, the aperture area being less than an effective summation area of the cord area and the protrusion area.

9. The adjustable zipper pull assembly as set forth in claim 1, wherein the protrusions are flexible relative to the slidable member such that they deflect inward toward the cord as the slidable member slides over the protrusions.

10. The adjustable zipper pull assembly as set forth in claim 1, wherein the slidable member is in a locked position when between two adjacent protrusions.

11. The adjustable zipper pull assembly as set forth in claim 1, wherein the first and second apertures are oriented in a side-by-side arrangement.

12. The adjustable zipper pull assembly as set forth in claim 1, wherein the slidable member includes a body and first and second arcs extending from the body, the first and second arcs surrounding at least a portion of the first and second apertures, respectively, and wherein the first region of the cord is received between the body and the first arc through the first aperture, and the second region of the cord is received between the body and the second arc through the second aperture.

* * * * *